United States Patent [19]

Chittom

[11] 3,967,916

[45] July 6, 1976

[54] FAN ASSEMBLY

[76] Inventor: Charles N. Chittom, 728 S. Wheeling, Tulsa, Okla. 74104

[22] Filed: Dec. 23, 1974

[21] Appl. No.: 535,826

Related U.S. Application Data

[63] Continuation-in-part of Ser. No. 368,820, June 11, 1973, abandoned.

[52] U.S. Cl. ..... 416/167; 165/39; 416/162; 416/164

[51] Int. Cl.[2] ..... F04D 29/36

[58] Field of Search ..... 165/39, 122; 416/162–164, 136, 137, 157, 167, 39, 166, 168; 415/129, 219 R; 261/DIG. 11

[56] References Cited

UNITED STATES PATENTS

| | | | |
|---|---|---|---|
| 457,513 | 8/1891 | Littlejohn | 416/136 |
| 2,010,640 | 8/1935 | Michl | 416/136 |
| 2,225,209 | 12/1940 | Dewey | 416/39 |
| 2,478,244 | 8/1949 | Cooley | 416/163 |
| 2,743,088 | 4/1956 | Bach | 165/122 |
| 2,826,395 | 3/1958 | Petty | 165/39 |
| 2,844,303 | 7/1958 | Kristiansen | 416/164 |
| 3,116,794 | 1/1964 | Walker et al. | 416/167 |
| 3,148,735 | 9/1964 | Miller et al. | 416/157 |
| 3,173,343 | 3/1965 | Berry | 416/162 X |

FOREIGN PATENTS OR APPLICATIONS

| | | | |
|---|---|---|---|
| 940,779 | 6/1948 | France | 416/137 |
| 1,175,810 | 4/1959 | France | 416/165 |
| 4,221 | 2/1971 | Japan | 416/162 |
| 674,657 | 6/1952 | United Kingdom | 416/162 |

*Primary Examiner*—Everette A. Powell, Jr.
*Attorney, Agent, or Firm*—Head, Johnson & Chafin

[57] ABSTRACT

A fan assembly particularly adaptable for use with an induced draft heat exchanger having a fan with a plurality of variable pitch blades, a drive mechanism and a pitch control mechanism, wherein the drive mechanism and the pitch control mechanism are designed to be located upstream of the heating element on the cool-air side of the heat exchanger. The pitch control mechanism is coupled directly to the rotating fan shaft, separate from the frame member for the heat exchanger to prevent problems in the alignment of the bearings for supporting the fan assembly. A fail safe mechanism is also provided in the rotating assembly of the fan to insure maximum pitch of the fan blades if the pitch control mechanism fails.

6 Claims, 3 Drawing Figures

FAN ASSEMBLY

CROSS-REFERENCES

This application is a continuation-in-part of now abandoned application Ser. No. 368,820, filed June 11, 1973 for a "COOLING FAN BLADE PITCH CONTROL".

FIELD OF THE INVENTION

The present invention relates to rotating fan assemblies and more particularly, but not by way of limitation, it is concerned with large size fan blade assemblies, in which it is important to be able to rotate each of the blades about its own axis to vary the pitch of the blades for control of the air flow by the fan while running at a constant speed. The invention further relates to a pitch control mechanism which may be located remote from the rotating fan blades on the main fan rotating shaft without encountering the problems normally encountered in bearing alignment.

DESCRIPTION OF THE PRIOR ART

In the prior art a number of systems have been described which provide for pitch control of the fan blades. However, in the field of induced draft heat exchangers, there is a very difficult problem which must be dealt with. In the first place, it is highly desirable to locate those mechanisms requiring seals and heat sensitive items out of the hot air stream while still providing full draft control of the fan blades (must be) located in the hot air stream.

To locate the fan blade assembly within the hot air stream and the drive and pitch control mechanism outside the hot air stream it is necessary that they be mounted on a common rather long rotating shaft which immediately gives rise to bearing alignment problems. A typical induced draft heat exchanger which is vertically mounted often stands 10 to 15 feet high with the blade assembly located in the uppermost part thereof and with the drive mechanism and pitch control mechanism located in the lower part of the heat exchanger below the heat exchange element. The main drive sheave sometimes 25 to 50 inches in diameter, is located on the lower part of the rotating shaft.

To secure the pitch control mechanism to the lower end of the shaft below the drive sheave by using prior art mechanisms, it would be necessary to bridge around the drive sheave with a bearing support assembly thereby creating alignment problems which are almost impossible to cope with since the bearings would have to be aligned throughout the entire rotating shaft.

SUMMARY OF THE INVENTION

The present invention is particularly designed and constructed for overcoming the disadvantages incurred in attempting to utilize the pitch control mechanisms of the prior art. In the present invention a fan system may be constructed separate from the heat exchanger assembly. The blade assembly of the fan system is located at one end of an elongated drive shaft, the other end being provided with the pitch control assembly which is mounted directly to the rotating shaft itself. Upon assembly, the entire fan system may be mounted in support bearings within the frame of the heat exchanger while the pitch control mechanism is connected directly to the shaft, no framework is required to bridge around the sheave member to support the control mechanism.

Further, the fan blade pitch control system utilizes a central axial tension member for control of the pitch of the blades. The system employs a cam means that controls the pitch of the blades and is attached to an axial rod located within the rotating fan shaft. The rod is supported at one end by a compression spring so that a continuous tensile force in the rod is required to maintain any desired pitch angle of the blades. Since the rod is always in tension it is self supporting between the spring point and the applied force so that no bearings are required between the tensile member, or rod and the surrounding tubular shaft which supports the fan blades. Further, since the rod is supported by a compression spring, the rotating assembly is constructed so that if the pitch control mechanism fails, the blade will automatically rotate to a maximum pitch position to insure a continued draft through the heat exchanger.

Bridging around the sheave also creates another more serious problem of subjecting the main support bearings to excessive thrust loads. If the axial rod is actuated or pulled downwardly from a frame mounted structure, that downward load is added to the load already present in the tubular shaft bearings. However, by attaching the linear actuator directly to the tubular shaft and loading the axial rod with respect thereto, the only added thrust loads in the main bearing is that due to the weight of the pitch control mechanism itself.

BRIEF DESCRIPTION OF THE DRAWINGS

Other and further objects and advantageous features of the present invention will hereinafter more fully appear in connection with a detailed description of the drawings in which.

DESCRIPTION OF THE PREFERRED EMBODIMENT

Figure 1:
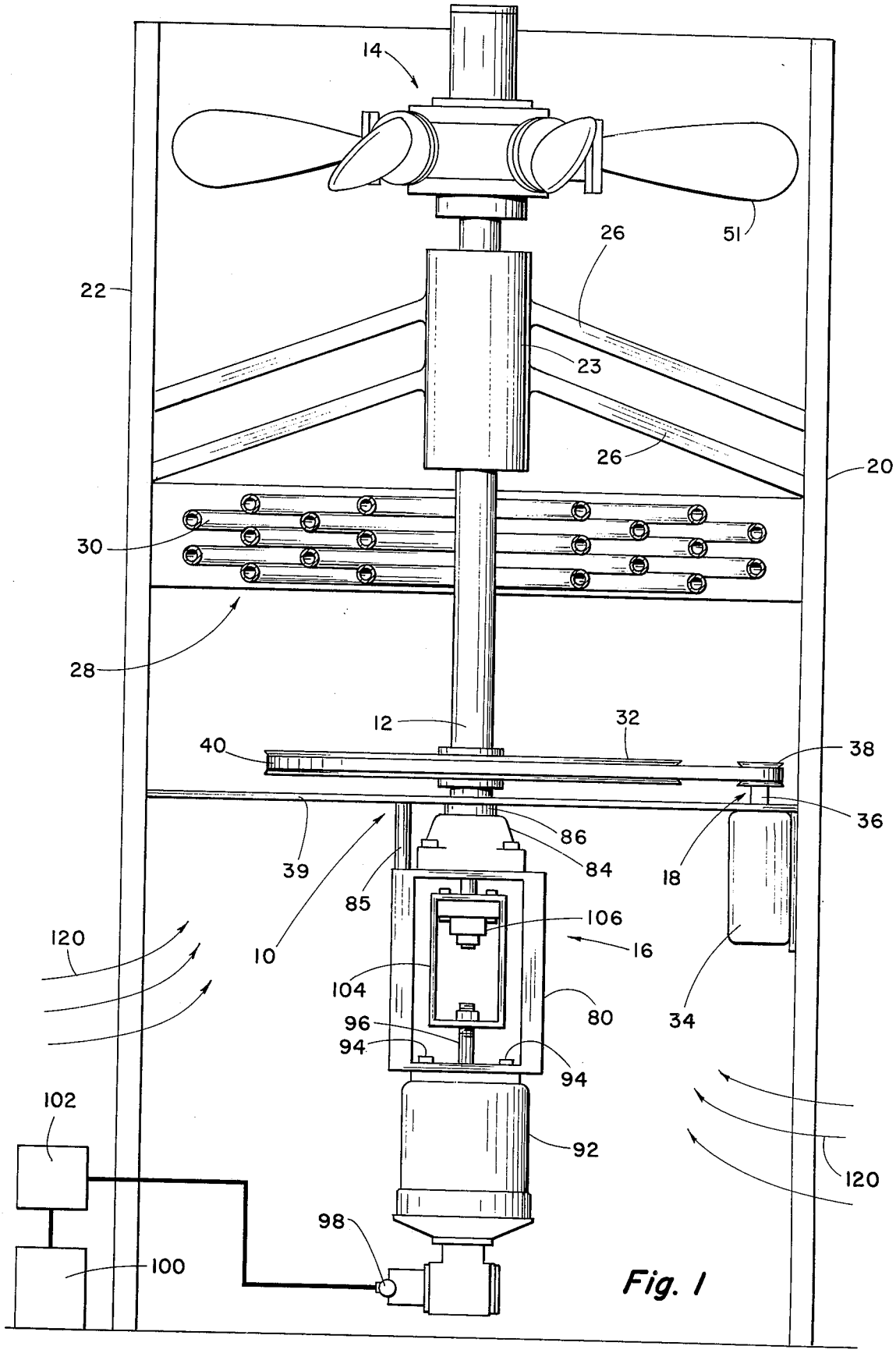
FIG. 1 is an elevational view of an induced draft heat exchanger employing a fan assembly which embodies the present invention.

Referring to the drawings in detail, reference character 10 indicates a fan assembly which generally comprises an elongated tubular or hollow drive shaft 12, a rotating blade assembly 14, secured at one end of the drive shaft 12, a pitch control mechanism 16 secured to the opposite end of the shaft 12 and a drive mechanism 18 secured to the shaft 12, adjacent the pitch control mechanism 16.

The fan assembly 10 is depicted as being vertically disposed within a heat exchanger assembly generally indicated by reference character 20. The heat exchanger assembly 20 generally comprises a vertically disposed frame structure 22 having at least one centrally disposed frame structure 23. The structure 23 is provided with at least one centrally disposed support bearing member 24. The structure 23 is connected to the frame member 22 by a plurality of radially extending support bridges or arms 26. The shaft 12 of the fan assembly 10 is journalled within the bearing members 24 and is rotationally supported thereby.

The heat exchanger 20 also comprises a heating element assembly 28 which may consist of a plurality of heating coils 30 which are attached to the frame member 22 and located between the rotating assembly 14 and the drive mechanism 18 of the fan assembly. The drive mechanism 18 normally comprises a rather large sheave 32 which is secured to the rotating shaft 12 of the fan assembly. A drive motor 34 is normally secured to the frame assembly 22, has a vertically extending motor shaft 36 having a small diameter sheave 38 secured thereto. Rotation is transferred from the motor 34 to the fan shaft 12 by means of a typical V-belt shown at reference character 40. Since the motor components and the V-belt drive are normally sensitive to excessive heat it is necessary to dispose same below the heating element assembly 28, or rather on the upstream side thereof. A sheave guard screen 39 is mounted to the frame 22 below the sheave 32.

Although the V-belt mechanism is the most common drive, it is pointed out that the invention herein described may be utilized with any type of drive mechanism such as a hollow shaft gear reducer with motor.

Figure 2:
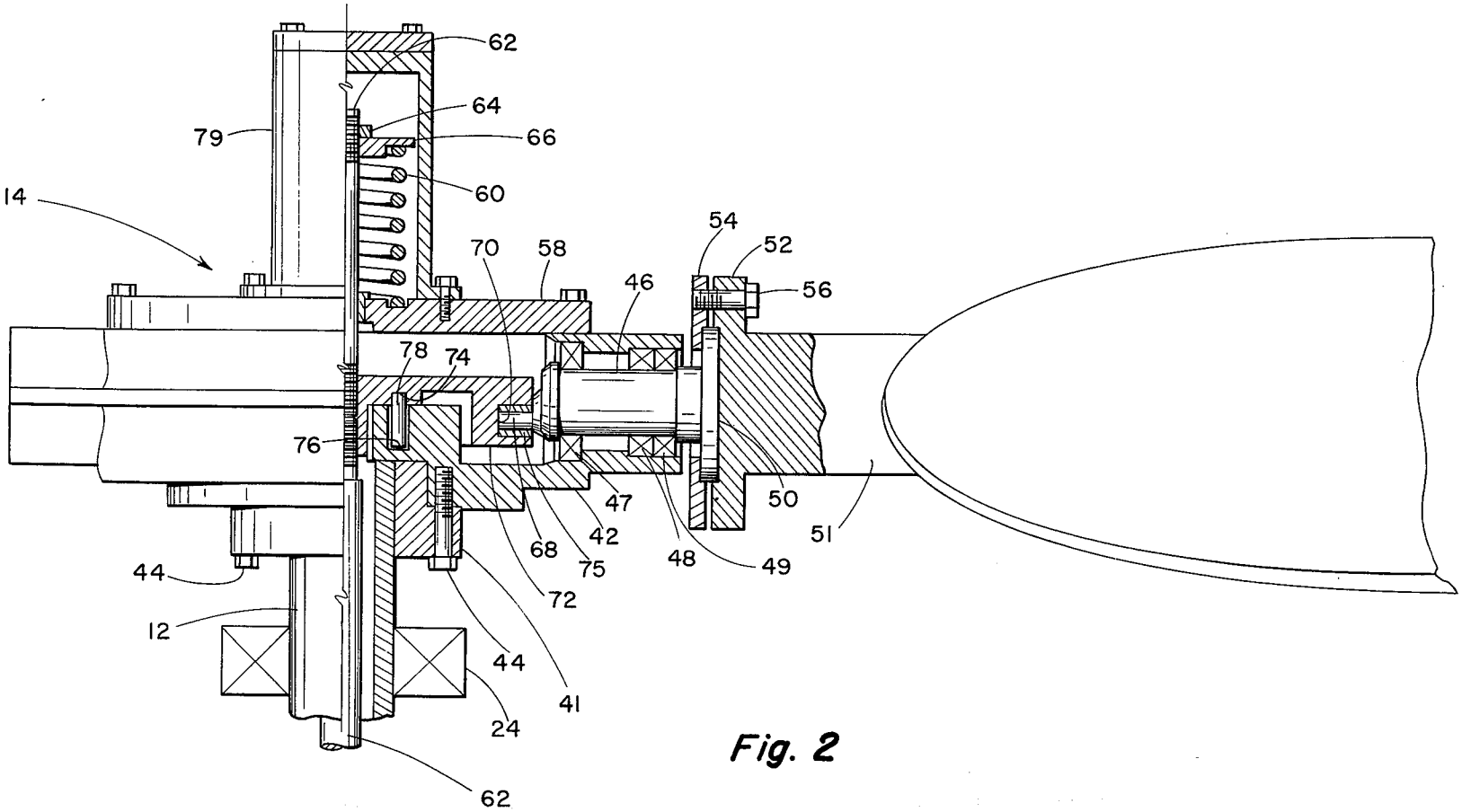
FIG. 2 is a partial sectional elevational view of the construction of the fan blade assembly and FIG. 3 is an elevational view of the pitch control mechanism of FIG. 1.

Referring now to FIG. 2, reference character 14 as hereinbefore set forth generally indicates the rotary blade assembly which is connected to the upper end of the shaft 12 which is in turn supported by bearings 24.

The tubular shaft 12 carries a hub 41 to which is attached a plate 42 by screws 44 which in turn supports a plurality of radial shafts 46 in bearings 47, 48 and 49. These shafts 46 also carry hubs 49 which are fastened to fan blades 51 by angularly adjustable flanges 52 and 54, which are held together by screws 56. There is a cover plate 58 which supports a helical spring 60 which carries a reciprocally disposed axial rod member 62 by means of a threaded ring 64 and plate 66 restraining one end of the spring 60.

Each radial shaft 46 for each fan blade 51 has a short crank arm 68 which is off-set from the centerline of the shaft 46, with the axis of the crank arm parallel to the shaft axis. The crank arms 68 are positioned in a circumferential channel 70 machined in the outer surface of a circular disc 72 which in turn is rigidly secured to the axial rod 62. Axial movement of rod 62 and associated disc 72 causes the crank arms 68 to be rotated and with them the shafts 46 of the fan blades 51. Bushing means 75 may be provided on the crank arms 68 to facilitate operation of the cam and crank arm movements. After the crank arms 68 have been installed in the circumferential groove 70, the disc member 72 is prevented from moving relative to the housing plate 42 by means of a pair of aligned facing bores 74 and 76 located in the disc member 72 and the housing plate 42 respectively, said bores being provided with a pin member 78. The spring 60 and associated equipment is covered by a housing 79.

As the assembly 14 rotates the tubular shaft 12 and hub 41 carrying the plates 42 and 58 with the radial rotatable shafts 46 and fan blades 51 all rotate as a unit, driven by the sheave 18.

The pitch of the fan blades 51 are oriented so that when the disc 72 is in its uppermost position, said fan blades 51 will be oriented for maximum pitch in order to produce the greatest amount of draft through the heat exchanger. It is readily seen that if no downward axial load is placed on the rod 62, the compression spring 60 will pull the rod 62 to its uppermost position thereby orienting the fan blades in their maximum pitch position.

Figure 3:
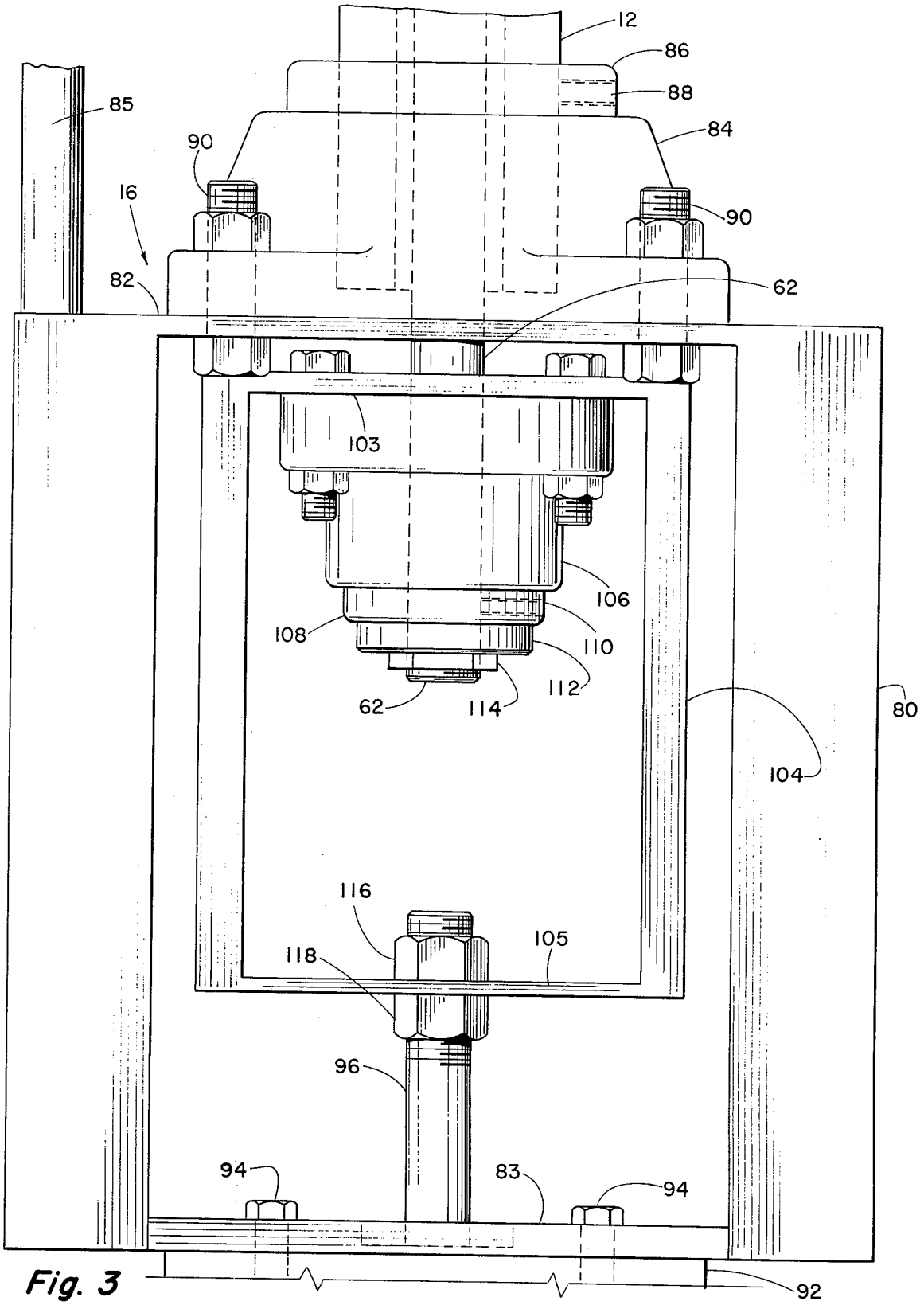

Referring now to FIGS. 1 and 3, as hereinbefore set forth, reference character 16 generally indicates the pitch control mechanism, said mechanism generally comprising an outer housing member 80, having parallel end plates 82 and 83 the upper end thereof being provided with a thrust bearing 84 having a rotational sleeve member 86 which is rigidly secured to the lower end of the fan shaft 12 by means of a suitable set screw 88. The thrust bearing 84 is attached to the upper end plate 82 of the housing 80 by a plurality of bolts 90. A brace member 85 is used to attach the housing 80 to the screen guard 39 to prevent rotation of the housing 80 due to bearing friction.

A pneumatic linear actuator means 92 is secured to the lower end plate 83 of the outer housing 80 by a plurality of screws 94. The pneumatic linear actuator 92 is provided with an upwardly extending reciprocal rod member 96 which extends upwardly into the interior of the outer housing 80. The lower end of the actuator 92 is provided with air control ports 98 for connection with an exterior air compressor 100 through a suitable control panel 102.

The lower end of the axial pitch control rod 62 extends downwardly through the upper portion of the outer housing 80 and is rotatably secured to an inner housing 104 having end plates 103 and 105 by means of another thrust bearing 106. The thrust bearing 106 is secured to the upper end plate 103 and has a rotatable sleeve portion 108 which is rigidly secured to the lower end of the rod 62 by means of a suitable set screw 110. The end of the rod 62 may also be further secured to the rotating sleeve portion 108 by means of a spacer plate 112 and nut 114 which is threadedly attached to the end of the rod 62. The lower end plate 105 of the inner housing 104 is rigidly secured to the upper end of the reciprocal thrust rod 96 of the linear actuator 92 by means of a pair of oppositely facing nuts 116 and 118.

It is readily apparent that the entire pitch control assembly 16 and associated linear actuator means 92 is completely carried and suspended by the rotating shaft 12. Stated another way, it is not necessary to connect the linear actuating pitch control assembly directly to the frame 22 of the heat exchanger. This eliminates the almost insurmountable problem of aligning bores for carrying the bearing members associated with the rotating shaft 12 and associated rod 62.

In the manufacturing of a heat exchanger assembly as depicted in FIG. 1, it is often the case that the heat exchanger components are manufactured by one company and the rotating fan assembly by a separate company. Ordinarily this would create extremely difficult interface problems in providing suitable aligned bearings for carrying the rotating portion of the fan assembly. However, with the present invention, the fan assembly including the rotating blade assembly 14, the rotating shaft 12 and the pitch control mechanism 16 may all be manufactured in one location without any significant bearing alignment problems and shipped directly to the manufacturer of the heat exchanger assembly 20. The heat exchanger manufacturer may then install the assembly by simply suspending the fan assembly by means of the bearings 24, attaching the motor 34 to the frame 22 and connecting the sheaves 38 and 18 by means of a belt 40. The linear actuator means 92 is then simply connected to the remote control panel 102 which in turn is connected to a suitable air supply source 100 and the heat exchanger assembly is ready for operation.

In operation, when the motor 34 is actuated, rotation is transferred to the main fan shaft 12 by means of the sheave 18 and pulley belt 40.

Upon rotation of the blade assembly 14, air is pulled in, through and around the lower portion of the frame 22 of the heat exchanger as indicated by the arrows 120, pulled past and through the heat exchanger elements 30 and forced upwardly through the upper portion of the heat exchanger assembly 20.

As hereinbefore set forth, the amount of draft being pulled through the heat exchanger assembly may be varied without changing motor speed by changing the pitch of the blades 51 on the rotary assembly 14. This change in pitch of the blades is accomplished by the linear actuator means 92 from the control panel 102.

If it is desirable to reduce the pitch of the blades to move less air through the heat exchanger, the linear actuator 92 is activated to retract the reciprocal rod 96 pulling said rod 96 downwardly. The downward movement of the rod 96 in turn causes the inner housing 104 of the pitch control mechanism to also move downwardly with respect to the outer housing 80, thereby pulling the axial pitch control rod 62 downwardly through the hollow rotating shaft 12.

Referring now to FIG. 2, as the rod 62 is pulled downwardly thereby compressing the spring 60, the disc member 72 is also pulled downwardly thereby rotating the cam arm 68 which in turn rotates the shaft 46, thereby simultaneously flattening or lessening the pitch of all the fan blades 51 therearound.

Likewise, if it is desirable to increase the pitch of the blades 51, the actuator rod 96 of the linear actuator means 92 is extended upwardly thereby pushing the inner housing 104 upwardly with respect to the outer housing 80, thereby pushing the axial rod 62 upwardly within the hollow fan shaft 12. The upward movement of the rod 62 causes the disc member 72 also to move upwardly, thereby turning the crank arm 60 which in turn rotates the blades 51 to a greater pitch, thereby increasing the air draft through the heat exchanger.

It is also noted that if the linear actuator means 92 fails due to lack of air pressure or the like, the spring 60 located in the housing 79 of the rotating blade assembly will pull the rod 62 upwardly thereby adjusting the pitch of the blades to maximum pitch so that maximum draft through the heat exchanger is insured. It is also noted that the compression spring 60 operating against the linear actuator 92 keeps the axial rod 62 always in tension, thereby substantially eliminating any need for spacer bushings and the like to be located between the axial rod 62 and the fan shaft 12.

It is also noted that there will normally be a torque on each of the fan blade mounting shafts 46 due to unbalanced air pressure against the blades, tending to rotate the blades and associated shafts 46 in the bearings 47, 48 and 49. Thus, there must at all times be a restraining torque on the shaft 46, through the crank arms 68, by means of the cam disc 72. The adjustment of the device is such that the compression in the spring 60 is greater than the largest torque and force required to restrain the plurality of fan blades and control their pitch.

It is also noted that if it is so desirable, the fan blades may be mounted to the hub assembly in such a way that in case of failure of the actuator means the spring 60 will cause the blades to be moved to minimum pitch.

From the foregoing it is apparent the present invention provides a rotatable fan assembly which is particularly adaptable for use with induction draft heat exchangers whereby the pitch angle of the blades may be varied by a pitch control mechanism which is located upstream of the heating elements of the heat exchanger, while constantly maintaining the bearing alignment necessary for operation of the pitch control mechanism.

Whereas, the present invention has been described in particular relation to the drawings attached hereto, it is obvious that other and further modifications of the invention apart from those shown or suggested herein may be made within the spirit and scope of the invention.

What is claimed:

1. A fan comprising:

a. an elongated rotatable tubular shaft;

b. a fan blade assembly secured to one end of the tubular shaft, said fan blade assembly comprising a hub means secured to the tubular shaft, a plurality of circumferentially spaced outwardly extending fan blades carried by the hub means, each fan blade being rotatable about its own longitudinal axis;

c. elongated axial rod carried by the hub means, and reciprocally disposed inside the tubular shaft, means for operably connecting the axial rod to the fan blades for rotation of the fan blades about their longitudinal axis for changing the pitch of said fan blades when the elongated axial rod is longitudinally moved with respect to the tubular shaft;

d. pitch control means completely supported by the opposite end of the tubular shaft and comprising a first outer housing, a first thrust bearing carried by the outer housing and rotatably secured to the end of the tubular shaft, a linear actuator means secured to the outer housing and oppositely disposed from the first thrust bearing, said actuator means having a movable portion, a second housing disposed within the outer housing, a second thrust bearing carried by the second housing rotatably secured to the end of the axial rod, the movable portion of the actuator means secured to the second housing and oppositely disposed from the second thrust bearing;

e. means connected to the linear actuator means for reciprocally moving the second housing with respect to the outer housing, thereby reciprocally moving the axial rod with respect to the tubular shaft said movement being parallel to the centerline axis of the tubular shaft for changing the pitch of the fan blades.

2. A fan as set forth in claim 1 and including pitch biasing means carried by the fan blade assembly and operably connected to the opposite end of the elongated rod for maintaining axial tension force on the elongated rod and capable of keeping said opposite end of said rod centered within the tubular shaft.

3. A fan as set forth in claim 2 wherein the means to maintain the tension force on the elongated rod comprises a spring retaining plate secured at said opposite end of said rod and a compression spring surrounding the elongated rod, the ends of which are engageable with the spring retaining plate and the fan blade assembly.

4. A fan as set forth in claim 3 wherein the tension force in said elongated rod is always greater than the reaction force of the fan blades on said elongated rod.

5. A fan as set forth in claim 1 wherein the first thrust bearing is rigidly secured to one end of the outer housing, the end of the tubular shaft being rotatably secured to said first thrust bearing, the end of the elongated rod extending through the first thrust bearing terminating inside the outer housing, the actuator means being rigidly secured to the opposite end of the outer housing, with the movable portion thereof extending through the housing and terminating inside the second housing; and wherein the second housing is interior of the outer housing, the second thrust bearing being of the second housing, one end of the elongated rod being rotatably secured to the second thrust bearing, the movable portion of the actuator means being secured to the second housing opposite the second thrust bearing.

6. An induced draft heat exchanger comprising a vertical housing, heat exchange elements disposed within said housing intermediate the upper and lower ends of said housing, centrally disposed fan support means carried by said housing, drive means carried by said housing and disposed below the heat exchange elements; a fan assembly disposed within said housing and comprising: an elongated vertically disposed tubular shaft disposed within the housing and rotatably secured to the fan support means, means for operably connecting the drive means to the tubular shaft to effect rotation thereof, a fan blade assembly having variable pitch fan blades secured to the upper end of the tubular shaft, elongated rod centrally and reciprocally disposed within the tubular shaft and rotatable therewith, one end of said rod being supported by the fan blade assembly, means cooperating between the rod and the fan blade assembly for varying the pitch of the fan blades upon reciprocation of the rod within the shaft, pitch control means completely supported by the opposite end of the tubular shaft and comprising a outer housing, first thrust bearing carried by the outer housing for securing the end of the tubular shaft rotatable with respect to the outer housing, linear actuator means secured to the outer housing and having a portion reciprocally vertically movable, a second housing disposed within the outer housing, a second thrust bearing carried by the second housing for rotatably securing the lower end of the elongated rod with respect to the second housing, said second housing being secure to the movable portion of the linear actuator means, control means operably connected to the linear actuator means for selectively moving the movable portion of the linear actuator means to change the fan blade pitch.

* * * * *